US009995158B2

(12) United States Patent
Henderson et al.

(10) Patent No.: US 9,995,158 B2
(45) Date of Patent: Jun. 12, 2018

(54) SPLIT NOZZLE RING TO CONTROL EGR AND EXHAUST FLOW

(71) Applicant: BorgWarner Inc., Auburn Hills, MI (US)

(72) Inventors: Kurt Henderson, Candler, NC (US); Rajendra Vemula, Arden, NC (US)

(73) Assignee: Borg Warner Inc., Auburn Hills, MI (US)

( * ) Notice: Subject to any disclaimer, the term of this patent is extended or adjusted under 35 U.S.C. 154(b) by 289 days.

(21) Appl. No.: 14/759,544

(22) PCT Filed: Dec. 19, 2013

(86) PCT No.: PCT/US2013/076473
§ 371 (c)(1),
(2) Date: Jul. 7, 2015

(87) PCT Pub. No.: WO2014/109883
PCT Pub. Date: Jul. 17, 2014

(65) Prior Publication Data

US 2015/0345316 A1 Dec. 3, 2015

Related U.S. Application Data

(60) Provisional application No. 61/752,007, filed on Jan. 14, 2013.

(51) Int. Cl.

| | |
|---|---|
| ***F01D 25/24*** | (2006.01) |
| ***F01D 9/02*** | (2006.01) |
| ***F02B 37/013*** | (2006.01) |
| ***F01D 17/10*** | (2006.01) |

(52) U.S. Cl.
CPC ..... *F01D 9/026* (2013.01); *F01D 17/105* (2013.01); *F02B 37/013* (2013.01); *F05D 2220/40* (2013.01)

(58) Field of Classification Search
CPC ..... F01D 9/041; F01D 9/048; F01D 9/045; F01D 9/026; F05D 2250/51
See application file for complete search history.

(56) References Cited

U.S. PATENT DOCUMENTS 3,614,259 A * 10/1971 Neff ..... F01D 9/026 415/151
4,809,509 A 3/1989 Hohkita
5,372,485 A * 12/1994 Sumser ..... F01D 17/14 415/166

(Continued)

*Primary Examiner* — Ninh H Nguyen
(74) *Attorney, Agent, or Firm* — Young Basile Hanlon & MacFarlane, P.C.

(57) ABSTRACT

A turbocharger (10) for an internal combustion engine includes a symmetric twin-volute turbine housing (12) having first and second volutes (16, 18). A turbine wheel (22) is disposed within the symmetric twin-volute turbine housing (12) for rotation about a turbocharger axis (R1). A nozzle ring (42, 58) is fixedly secured to the symmetric twin-volute turbine housing (12). The nozzle ring (42, 58) includes a plurality of fixed vanes (44, 62, 66) disposed circumferentially around the turbocharger axis (R1). The plurality of fixed vanes (44, 62, 66) form nozzle passages leading from at least one of the first and second volutes (16, 18) to the turbine wheel (22) for directing exhaust gas against the turbine wheel (22) at an optimum angle.

9 Claims, 3 Drawing Sheets

(56) References Cited

U.S. PATENT DOCUMENTS

| | | | | |
|---|---|---|---|---|
| 5,454,225 | A * | 10/1995 | Sumser | F01D 9/045 415/166 |
| 7,428,814 | B2 * | 9/2008 | Pedersen | F01D 9/026 415/202 |
| 8,128,356 | B2 * | 3/2012 | Higashimori | F01D 17/148 415/205 |
| 8,857,178 | B2 * | 10/2014 | O'Hara | F01D 9/026 29/889.2 |
| 2007/0175214 | A1 | 8/2007 | Residorf et al. | |
| 2007/0209361 | A1 | 9/2007 | Pedersen et al. | |
| 2009/0041577 | A1 | 2/2009 | Serres | |

* cited by examiner

SPLIT NOZZLE RING TO CONTROL EGR AND EXHAUST FLOW

CROSS-REFERENCE TO RELATED APPLICATION

This application claims priority to and all benefits of U.S. Provisional Application No. 61/752,007 filed on Jan. 14, 2013, and entitled "Split Nozzle Ring To Control EGR And Exhaust Flow."

BACKGROUND OF THE INVENTION

1. Field of the Invention

This invention relates to a turbocharger for an internal combustion engine. More particularly, this invention relates to a turbocharger including a symmetric twin-volute turbine housing having a nozzle ring with fixed vanes.

2. Description of Related Art

A turbocharger is a type of forced induction system used with internal combustion engines. Turbochargers deliver compressed air to an engine intake, allowing more fuel to be combusted, thus boosting an engine's power without significantly increasing engine weight. Thus, turbochargers permit the use of smaller engines that develop the same amount of power as larger, normally aspirated engines. Using a smaller engine in a vehicle decreases the mass of the vehicle, increasing performance and enhancing fuel economy. Moreover, the use of turbochargers permits more complete combustion of the fuel delivered to the engine, which reduces emissions.

Generally, turbochargers use exhaust gas from an exhaust manifold to drive a turbine wheel, which is housed within a turbine housing. The turbine wheel and turbine housing define a turbine or turbine stage of the turbocharger. The turbine wheel is secured to one end of a shaft and a compressor impeller is secured to another end of the shaft such that rotation of the turbine wheel causes rotation of the compressor impeller. The compressor impeller is housed within a compressor housing. The compressor impeller and compressor housing define a compressor or compressor stage of the turbocharger. A bearing housing couples the turbine housing and the compressor housing together. The shaft is rotatably supported in the bearing housing. As the compressor impeller rotates, it draws in ambient air and compresses it before it enters into the engine's cylinders via an intake manifold. This results in a greater mass of air entering the cylinders on each intake stroke. Once the exhaust gas has passed through the turbine wheel, the spent exhaust gas exits the turbine housing and is usually sent to after-treatment devices such as catalytic converters, particulate traps, and Nitrogen Oxide ($NO_x$) traps before exiting to atmosphere.

The turbine converts the exhaust gas into mechanical energy to drive the compressor. The exhaust gas enters the turbine housing at an inlet, flows through a scroll or volute, and is directed into the turbine wheel located in the center of the turbine housing. After the turbine wheel, the exhaust gas exits through an outlet or exducer. The exhaust gas, which is restricted by the turbine's flow cross-sectional area, results in a pressure and temperature drop between the inlet and outlet. This pressure drop is converted by the turbine into kinetic energy to drive the turbine wheel. Energy transfer from kinetic energy into shaft power takes place at the turbine wheel, which is designed so that nearly all the kinetic energy is converted by the time the exhaust gas reaches the turbine outlet.

In order to optimize the flow of exhaust gas to the turbine wheel, it is well known to include a nozzle ring which includes a series of curved vanes on a flange which form nozzle passages leading from the volute to the turbine wheel. The nozzle ring is sandwiched between the bearing housing and the turbine housing and the vanes direct the exhaust gas against the turbine wheel at an optimum angle.

Exhaust gas recirculation (EGR) is widely recognized as a significant method for reducing the production of $NO_x$ during the combustion process. The recirculated exhaust gas partially quenches the combustion process and lowers the peak temperature produced during combustion. Since $NO_x$ formation is related to peak temperature, recirculation of exhaust gas reduces the amount of $NO_x$ formed. In order to recirculate exhaust gas into the intake manifold, the exhaust gas must be at a pressure that is greater than the pressure of the intake air. However, if the pressure of the exhaust gas is excessive, the exhaust gas creates backpressure on the engine that is detrimental to overall fuel efficiency and performance.

One approach for ensuring sufficient exhaust gas pressure to promote EGR, while preventing excessive backpressure on the engine, is to use an asymmetric twin-volute turbine housing which incorporates two volutes of different sizes for separate exhaust gas routing of different cylinder groupings. A smaller volute coupled to a first cylinder grouping achieves EGR through higher exhaust gas backpressure built-up in front of the turbine. A larger volute coupled to a second cylinder grouping provides a high turbine output using exhaust gas energy for optimum efficiency without being affected by the EGR. This combination provides optimum engine response and helps the engine to comply with global emissions standards while achieving better fuel economy and improved performance.

It is understood, however, that multiple designs of the asymmetric twin-volute turbine housing are necessary to meet the desired EGR and turbine performance parameters depending on the particular application.

It is desirable, therefore, to provide a symmetric twin-volute turbine housing which can be used with multiple nozzle rings to effectively create an asymmetric twin-volute turbine housing with the desired EGR and turbine performance parameters.

SUMMARY OF THE INVENTION

A turbocharger for an internal combustion engine includes a symmetric twin-volute turbine housing including first and second volutes. A turbine wheel is disposed within the symmetric twin-volute turbine housing for rotation about a turbocharger axis. A nozzle ring is fixedly secured to the symmetric twin-volute turbine housing. The nozzle ring includes a plurality of fixed vanes disposed circumferentially around the turbocharger axis. The plurality of fixed vanes form nozzle passages leading from at least one of the first and second volutes to the turbine wheel for directing exhaust gas against the turbine wheel at an optimum angle.

According to a first embodiment of the invention, the nozzle ring includes a plurality of fixed vanes disposed in a throat of one of the first and second volutes.

According to a second embodiment of the invention, the nozzle ring includes a first side having a plurality of first fixed vanes and a second side having a plurality of second fixed vanes. The plurality of first fixed vanes is disposed in a throat of the first volute and the plurality of second fixed vanes is disposed in a throat of the second volute.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EMBODIMENTS

Figure 1:
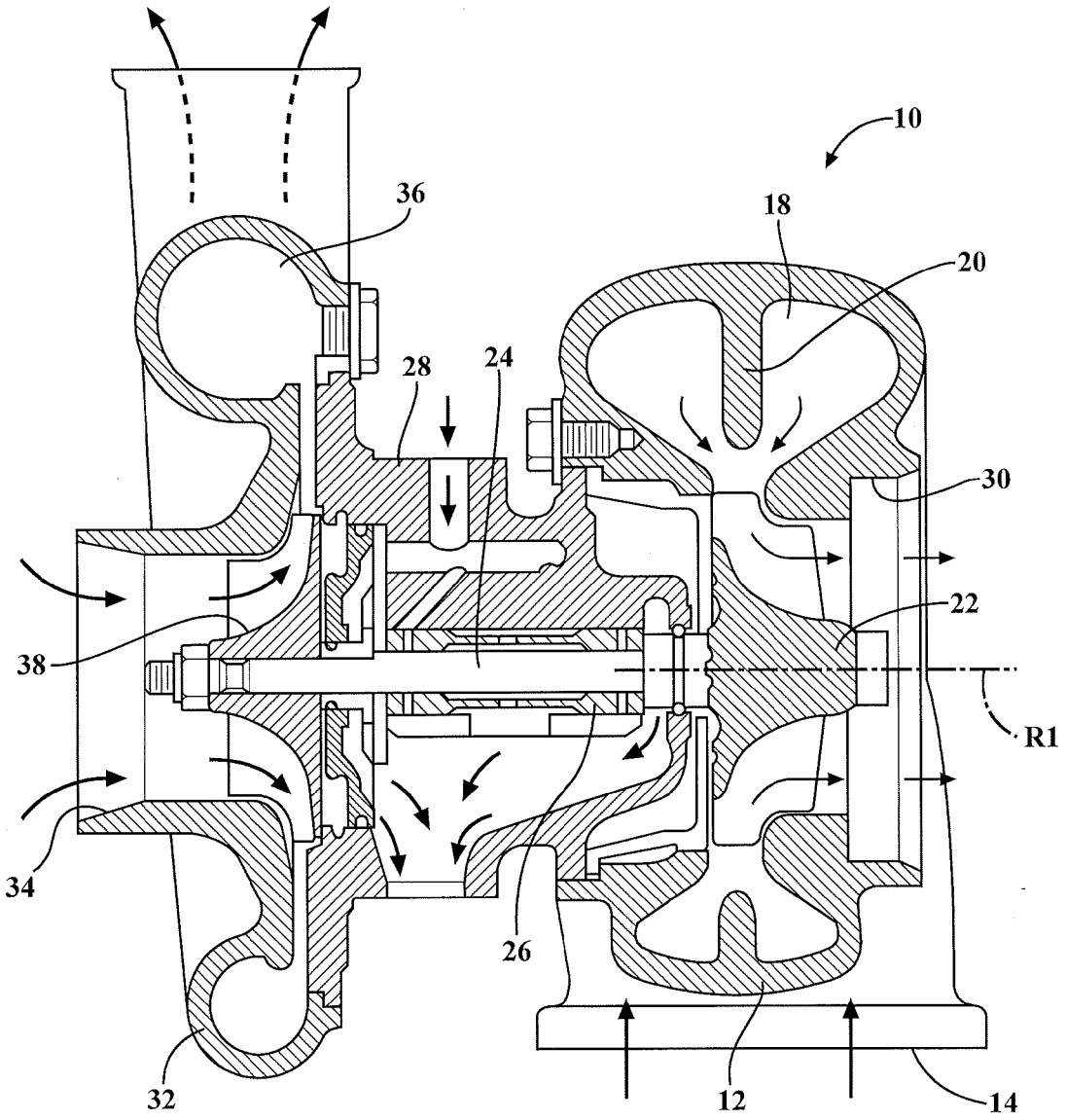
FIG. 1 is a cross-sectional view of a turbocharger with a symmetric twin-volute turbine housing for use with a nozzle ring according to the invention.

A cross-section of a turbocharger is illustrated generally at 10 in FIG. 1. The turbocharger 10 includes a turbine and a compressor. The turbine includes a turbine housing 12 and is supplied with exhaust gas through a turbine inlet 14 that is connected to an exhaust manifold (not shown). In a first embodiment of the invention, the turbine housing 12 is a symmetric twin-scroll or twin-volute design and includes first and second volutes 16, 18 which are axially adjacent to each other and separated by a divider wall 20. The first and second volutes 16, 18 extend circumferentially within the turbine housing 12 and the divider wall 20 provides separation of the exhaust gas pulsations of individual cylinder groupings. The symmetric twin-volute turbine housing 12 results in equal exhaust gas backpressure for each cylinder grouping and is used to improve low engine speed response by capturing low engine speed exhaust gas pulsations more effectively.

A turbine wheel 22 is disposed within the turbine housing 12 and is mounted on one end of a shaft 24 for rotation about a turbocharger axis R1. The shaft 24 is rotatably supported by a bearing system 26 in a bearing housing 28 that is disposed between the turbine and compressor. The turbine wheel 22 is rotatably driven by exhaust gas supplied from the exhaust manifold and, after driving the turbine wheel 22, the exhaust gas exits the turbine housing 12 through an exducer 30.

The compressor includes a compressor housing 32 and is supplied with ambient air through an inducer 34. The compressor housing 32 includes a compressor volute 36 that extends circumferentially therein. A compressor impeller 38 is disposed within the compressor housing 32 and is mounted to another end of the shaft 24 for rotation about the turbocharger axis R1 in response to rotation of the turbine wheel 22. As the compressor impeller 38 rotates, ambient air is drawn into the compressor housing 32 through the inducer 34 and is compressed by the compressor impeller 38 to be delivered at an elevated pressure through a compressor outlet 40 to an engine intake manifold (not shown).

Figure 2:
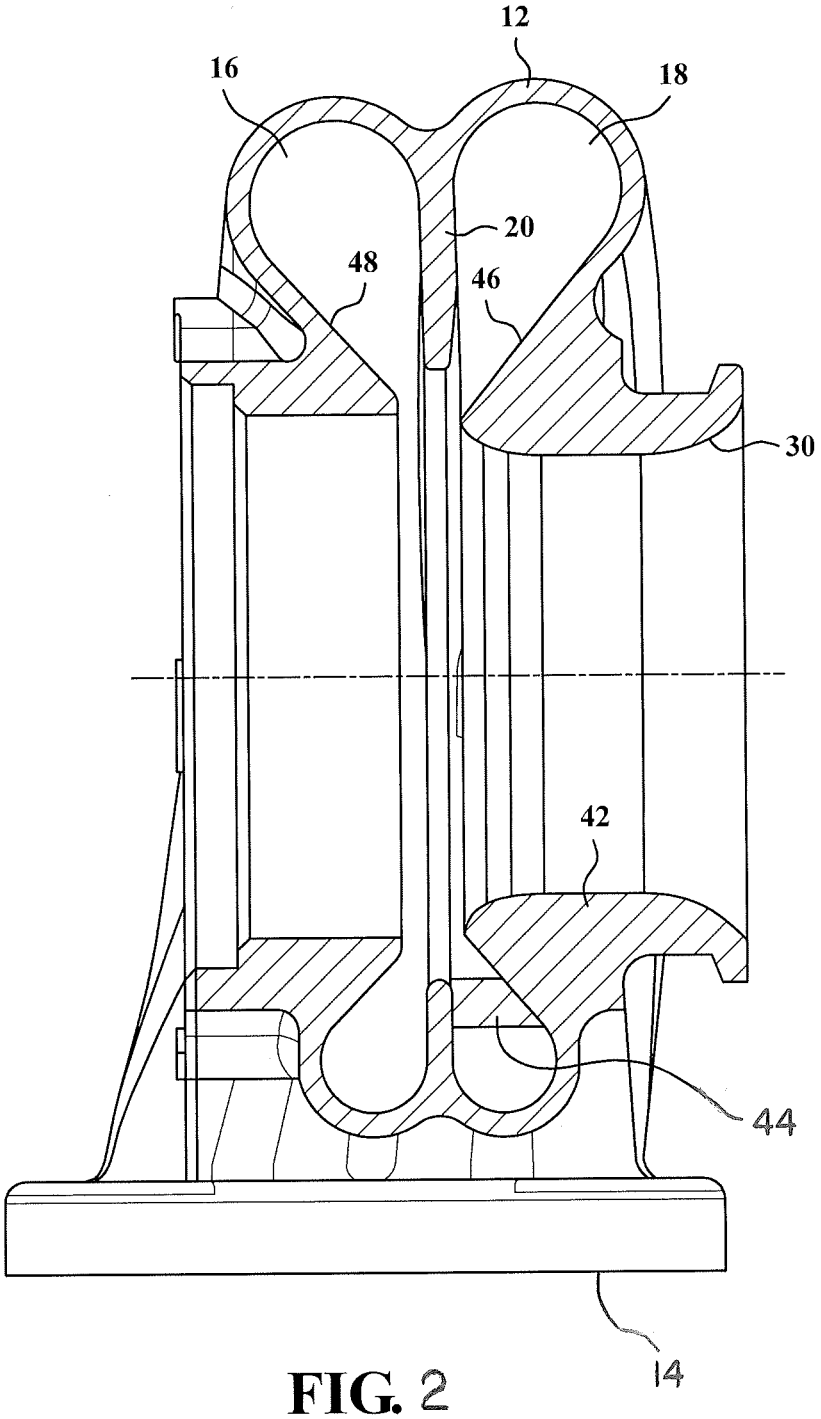
FIG. 2 is a cross-sectional view of the symmetric twin-volute turbine housing including a nozzle ring according to a first embodiment of the invention.

Referring to FIG. 2, the turbine includes a nozzle ring 42 having a plurality of fixed vanes 44 disposed circumferentially around the turbocharger axis R1. The fixed vanes 44 form nozzle passages leading from the second volute 18 to the turbine wheel 22 and direct the exhaust gas against the turbine wheel 22 at an optimum angle. The nozzle ring 42 is fixedly secured to the turbine housing 12. In the embodiment shown, the nozzle ring 42 is coupled to a contoured surface leading to the exducer 30. It is contemplated that the nozzle ring 42 could partially or completely replace the divider wall 20 without varying from the scope of the invention. The nozzle ring 42 is positioned such that the fixed vanes 44 act on the exhaust gas passing through a throat 46 of the second volute 18. It is appreciated, however, that the nozzle ring 42 may be positioned such that the fixed vanes 44 act on the exhaust gas passing through a throat 48 of the first volute 16 without varying from the scope of the invention. Since the first and second volutes 16, 18 are symmetric, and the fixed vanes 44 only act on the exhaust gas passing through the throat 46 of the second volute 18, the nozzle ring 42 effectively creates an asymmetric twin-volute turbine housing. As such, the second volute 18 and nozzle ring 42 create a higher exhaust gas backpressure for the corresponding cylinder grouping to assist with exhaust gas recirculation while the first volute 16 provides a high turbine output without being affected by the exhaust gas recirculation.

Figure 3B:
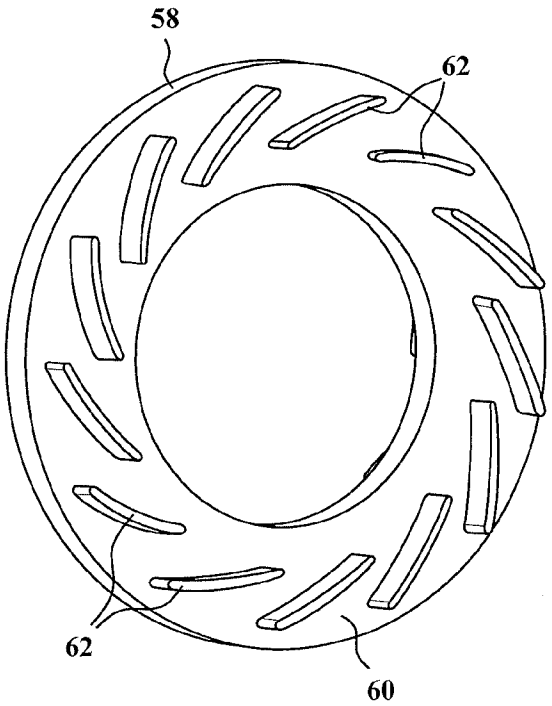
FIG. 3*b* is a perspective view of a first side of the split nozzle ring.
Figure 3A:
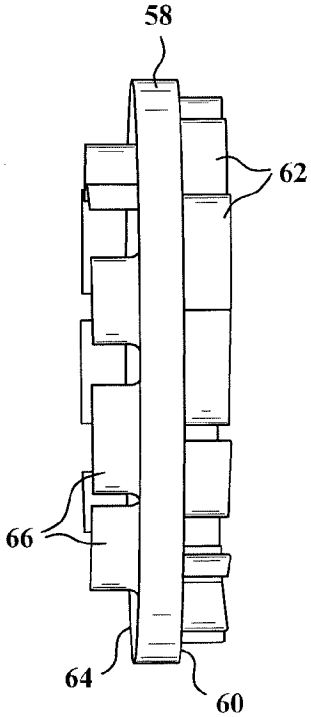
FIG. 3*a* is a side view of a split nozzle ring for use with the symmetric twin-volute turbine housing according to a second embodiment of the invention.
Figure 3C:
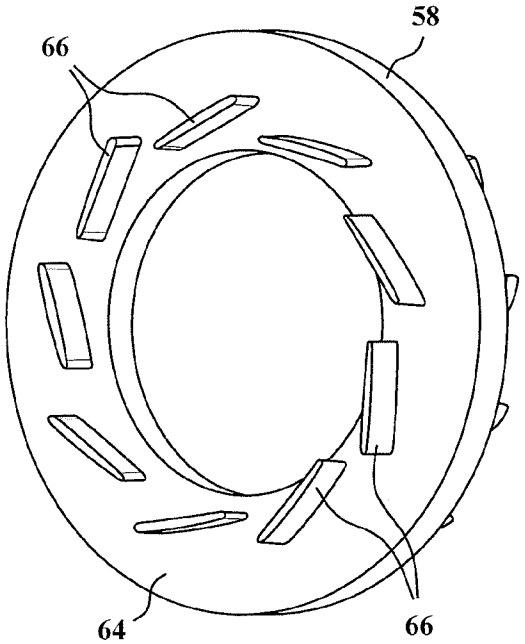
FIG. 3*c* is a perspective view of a second side of the split nozzle ring.

In a second embodiment of the invention, shown in FIGS. 3*a* through 3*c*, the turbine includes a split nozzle ring 58 having a first side 60 with a plurality of first fixed vanes 62 which form nozzle passages leading from the first volute 16 to a turbine wheel 22 and a second side 64 with a plurality of second fixed vanes 66 which form nozzle passages leading from the second volute 18 to the turbine wheel 22. The first and second fixed vanes 62, 66 direct the exhaust gas against the turbine wheel 22 at an optimum angle. In the embodiment shown, the split nozzle ring 58 includes thirteen first fixed vanes 62 and nine second fixed vanes 66, however, it is appreciated that the split nozzle ring 58 may include any number of first and second fixed vanes 62, 66 without varying from the scope of the invention. It is further appreciated that the vane count of the second fixed vanes 66 may be greater than the vane count of the first fixed vanes 62.

The split nozzle ring 58 is fixedly secured to the turbine housing 12 between the first and second volutes 16, 18. It is contemplated that the split nozzle ring 58 could partially or completely replace the divider wall 20. The nozzle ring 58 is positioned such that the first fixed vanes 62 act on the exhaust gas passing through the throat 48 of the first volute 16 and the second fixed vanes 66 act on the exhaust gas passing through the throat 46 of the second volute 18. The higher vane count of the first fixed vanes 62 create a higher exhaust gas backpressure for the corresponding cylinder grouping to assist with exhaust gas recirculation. In contrast, the lower vane count of the second fixed vanes 66 provide a high turbine output without being affected by the exhaust gas recirculation. As such, the split nozzle ring 58 effectively creates an asymmetric twin-volute turbine housing.

The invention has been described here in an illustrative manner, and it is to be understood that the terminology used is intended to be in the nature of words of description rather than limitation. Many modifications and variations of the present invention are possible in light of the above teachings. It is, therefore, to be understood that within the scope of the appended claims, the invention may be practiced other than as specifically enumerated within the description.

What is claimed:

1. A turbocharger for an internal combustion engine comprising:

a twin-volute turbine housing including first and second symmetric volutes that are axially adjacent to one another;

a turbine wheel disposed within said twin-volute turbine housing for rotation about a turbocharger axis; and a nozzle ring fixedly secured to said twin-volute turbine housing, said nozzle ring including a plurality of fixed vanes disposed circumferentially around said turbocharger axis and positioned within a throat of said second volute, wherein said plurality of fixed vanes form nozzle passages leading from only said second volute to said turbine wheel for directing exhaust gas against said turbine wheel at an optimum angle.

2. The turbocharger as set forth in claim 1 wherein said plurality of fixed vanes promote exhaust gas recirculation in said second volute without affecting said first volute.

3. The turbocharger as set forth in claim 2 wherein said nozzle ring is disposed axially between said first and second volutes.

4. A turbocharger for an internal combustion engine comprising:

a twin-volute turbine housing including first and second symmetric volutes that are axially adjacent to one another and separated by a divider wall;

a turbine wheel disposed within said twin-volute turbine housing for rotation about a turbocharger axis; and a nozzle ring fixedly secured to said twin-volute turbine housing, said nozzle ring including a first side having a plurality of first vanes and a second side having a plurality of second vanes, wherein the plurality of first vanes and the plurality of second vanes are disposed circumferentially around said turbocharger axis and extend axially away from said nozzle ring in opposite directions, wherein said plurality of first vanes form nozzle passages leading from said first volute to said turbine wheel, wherein said plurality of second vanes form nozzle passage from said second volute to said turbine wheel, and wherein a vane count of said plurality of first vanes does not equal a vane count of said plurality of second vanes.

5. The turbocharger as set forth in claim 4 wherein said plurality of first vanes promote exhaust gas recirculation, and wherein said plurality of second vanes promote a high turbine output.

6. The turbocharger as set forth in claim 5 wherein said nozzle ring is disposed axially between said first and second volutes such that said nozzle ring replaces at least a portion of said divider wall.

7. A turbine housing for a turbocharger, said turbine housing comprising:

a pair of symmetric volutes defining a first volute and a second volute that are axially adjacent to one another and separated by a divider wall;

an exducer configured to exhaust gas from said turbine housing, wherein said exducer is disposed closer to said second volute than said first volute;

a turbine wheel disposed within said turbine housing for rotation about a turbocharger axis; and a nozzle ring fixedly secured to said turbine housing, said nozzle ring including a first side having a plurality of first fixed vanes disposed circumferentially around said turbocharger axis and a second side having a plurality of second fixed vanes disposed circumferentially around said turbocharger axis wherein said first and second fixed vanes extend axially away from said nozzle ring in opposite directions, and wherein said plurality of first fixed vanes form nozzle passages leading from said first volute to said turbine wheel for directing exhaust gas against said turbine wheel at an optimum angle, wherein said plurality of second fixed vanes form nozzle passages leading from said second volute to said turbine wheel for directing exhaust gas against said turbine wheel at an optimum angle, and wherein a vane count of said plurality of second fixed vanes is greater than a vane count of said plurality of first fixed vanes.

8. The turbine housing as set forth in claim 7 wherein said plurality of first fixed vanes promote exhaust gas recirculation, and wherein said plurality of second fixed vanes promote a high turbine output.

9. The turbine housing as set forth in claim 8 wherein said nozzle ring is disposed axially between said first and second volutes such that said nozzle ring replaces at least a portion of said divider wall.

* * * * *